US005504951A

United States Patent [19]

Yeh

[11] Patent Number: 5,504,951

[45] Date of Patent: Apr. 9, 1996

[54] FOLDABLE BABY PLAYYARD

[76] Inventor: Chin C. Yeh, No. 27, Lane 297, Sec. 1, Pei Hsing Rd., Hsing Tien City, Taipei Hsien, Taiwan

[21] Appl. No.: 377,114

[22] Filed: Jan. 23, 1995

[51] Int. Cl.[6] ..... A47D 13/06; A47D 7/00

[52] U.S. Cl. ..... 5/99.1; 5/93.1

[58] Field of Search ..... 5/99.1, 93.1; 256/25; 16/343–347; 403/102, 99, 91

[56] References Cited

U.S. PATENT DOCUMENTS

| | | | |
|---|---|---|---|
| 5,239,714 | 8/1993 | Huang | 5/99.1 |
| 5,243,718 | 9/1993 | Shamie | 5/99.1 |
| 5,353,451 | 10/1994 | Hsiung | 5/99.1 |
| 5,381,570 | 1/1995 | Cheng | 5/99.1 |
| 5,446,931 | 9/1995 | Wei | 5/99.1 |
| 5,454,124 | 10/1995 | Huang | 5/99.1 |

*Primary Examiner*—Alexander Grosz
*Attorney, Agent, or Firm*—Morton J. Rosenberg; David I. Klein

[57] ABSTRACT

Disclosed is a foldable baby playyard having improved bottom foldable hub member and foldable rail joint connecting members. The improved structure of the foldable hub member and the foldable rail joint connecting members enable the playyard to be conveniently and quickly collapsed and folded to occupy a room as small as possible. On the other hand, the playyard can also be quickly extended again from the folded state to be safely used by a baby without the risk of becoming unexpectedly collapsed or unstably swayed due to any force applied to the foldable hub member and/or the foldable joint connecting members by the baby in the playyard.

2 Claims, 16 Drawing Sheets

FOLDABLE BABY PLAYYARD

BACKGROUND OF THE INVENTION

The present invention relates to a foldable baby playyard, and more particularly to a foldable baby playyard which has improved foldable bottom hub member and rail folding joints and thereby can be more safely and stably folded or erected. Moreover, the foldable baby playyard of the present invention has an optionally attached supporting rack for hanging a craddle or the like thereto.

Most of the baby cribs and playyards of nowadays have been so designed that they are convenient in use and occupy minimum room when they are not in use. Examples of such baby cribs and playyards include Taiwan Patent Pub. Nos. 218462, 160108, 187262, 195772, 218102, etc. All of these baby cribs and playyards have a foldable structure which is convenient and practical in use. The improvements of these cribs and playyards mainly focus on the bottom support below the crib and playyard framework as well as the foldability of the whole crib and playyard. For example, Taiwan Patent Pub. No. 195772 discloses a connecting member consisting of two first semi-circular tubular members and two second semi-circular tubular members which are not in a linear position but both are normal to the two first semi-circular tubular members; Taiwan Patent Pub. No. 218102 discloses a pivotal connecting member having a V-shaped seat with equally spaced grooves formed at two ends for pivotally engaging with connecting sleeves having opposite and corresponding projections; Taiwan Patent Pub. No. 187262 discloses a support positioning structure; Taiwan Patent Pub. No. 160108 discloses a hinge; and Taiwan Patent Pub. No. 218462 discloses a lower frame. However, all of these inventions neglect an important thing, that is, they permit the cribs and playyards to be conveniently collapsed but do not permit the same to be extended in an ideal way. A situation commonly existed in the cribs and playyards with the above inventions that the hinges, connecting members or pivotal connecting members on the crib or playyard framework often move beyond their critical points, that is, when the folded crib or playyard is extended again, the framework unstably sways because the joints connected by the above hinges, connecting members or pivotal connecting members are not strong enough to be the support points of the whole crib or playyard structure. This sway condition of the foldable crib or playyard due to uneven and weak connecting members at joints of the framework is of course great threat to the safety of baby using the crib or playyard. Even the additional floor cushions can not guarantee the safety of baby in the crib or playyard.

SUMMARY OF THE INVENTION

It is therefore a primary object of the present invention to provide a foldable playyard in which improved foldable bottom hub member and rail folding joint connecting members are included to enhance the strength and accordingly the safety of the playyard and thereby eliminates the drawbacks existed in the conventional foldable cribs and playyards.

Another object of the present invention is to provide an enhanced foldable playyard in which an optional supporting rack can be attached to the playyard to support a craddle thereon so that the playyard can be used as a craddle, too.

BRIEF DESCRIPTION OF THE DRAWINGS

The above and other objects of the present invention, as well as the special structure and operational means to achieve these objects can be best understood by referring to the following detailed description of the preferred embodiment and the accompanying drawings wherein.

DETAILED DESCRIPTION OF THE PREFERRED EMBODIMENTS

Figure 1:
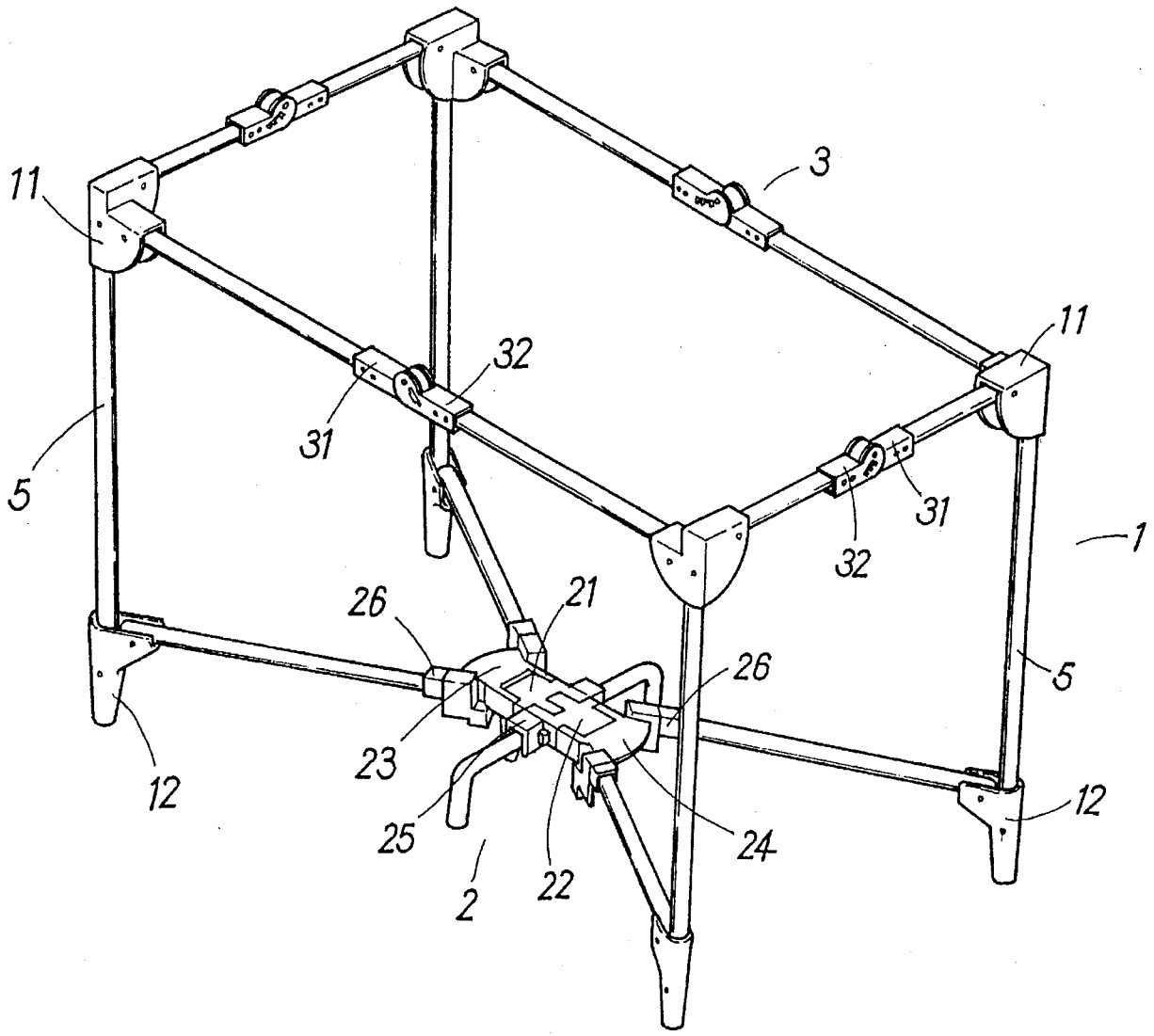
FIG. 1 is a perspective showing the framework of a foldable playyard according to the present invention in an erected state (without the optional supporting rack for craddle)

Please refer to FIGS. 1, 2, 3, and 16 the present invention of a foldable baby playyard mainly includes a framework 1 in which a foldable hub member 2 and a plurality of foldable joint connecting members 3 are used and together form the main improvement of the present invention. A supporting rack 4 is optionally and detachably attached to the framework 1 for hanging a craddle 6 thereon.

The framework 1 is substantially rectangular in shape and consists of a plurality of rails 5. The lower ends of the four vertical corner rails 5 are respectively connected with a lower corner leg connecting member 12 and the upper ends of the four vertical corner rails 5 are respectively and pivotally connected with an upper corner rail connecting member 11. Each pair of two adjacent upper corner rail connecting members 11 further have two symmetrical upper horizontal rails 5 extending between them. The joint of every two upper horizontal rails 5 between two adjacent upper corner rail connecting members 11 is connected by means of one of the foldable joint connecting members 3. The lower corner leg connecting members 12 each has a lower horizontal rail 5 pivotally connected thereto at one end and the other end of the lower horizontal rails 5 are pivotally connected to the foldable hub member 2.

Figure 6:
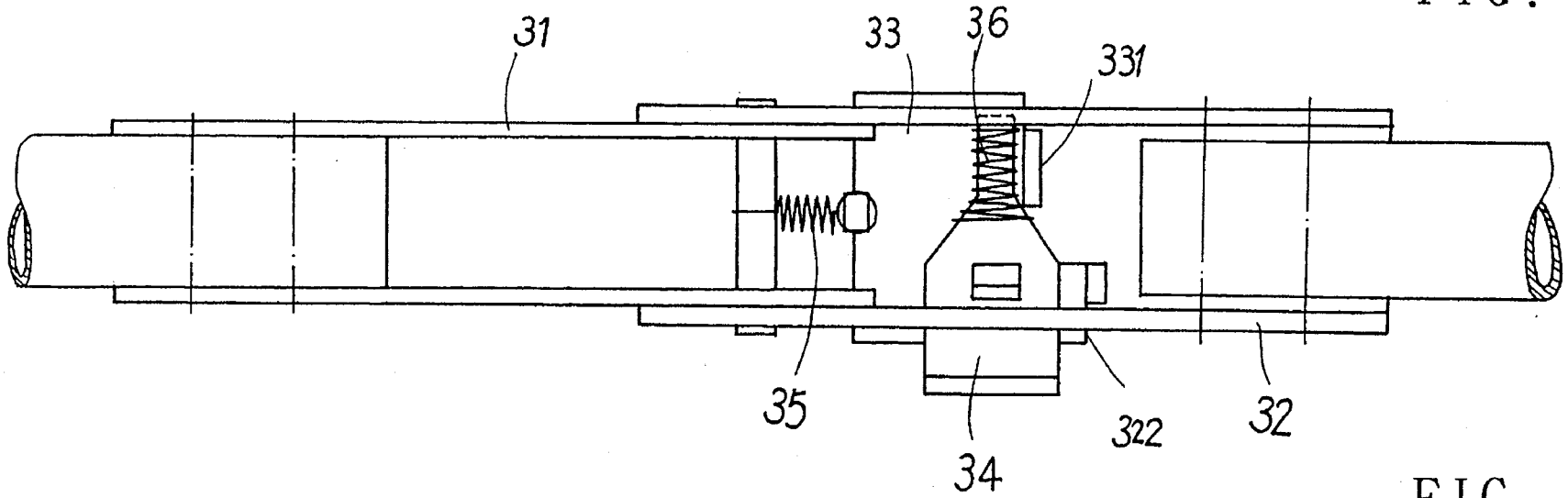
FIG. 6 is a bottom view of the foldable joint connecting member of FIG. 4.

Please further refer to FIGS. 4 through 9. The foldable joint connecting member 3 is disposed at each joint of two first horizontal rail 5 to pivotally connect the latter together while the latter are extending between a pair of two upper corner rail connecting members 11. Each of the foldable joint connecting members 3 comprises a left and a right tubular connecting components 31, 32. The left connecting component 31 is slightly smaller than the right connecting component 32 in its width, permitting the left connecting component 31 and the right connecting component 32 to connect with each other at their arcuated inner ends by means of a first shaft with the arcuated inner end of the left connecting component 31 being fitly received within the arcutated inner end of the right connecting component 32. The right connecting component 32 is provided at two side walls with a first slot 321 and a second slot 322, respectively. A stop plate 33 is disposed inside the right connecting component 32 with its two lateral sides separately extending through the first and the second slots 321, 322 and its inner end extending into and fitly engaging with two cuts formed at the arcuated inner end of the left connecting component 31. A first spring 35 is connected at one end to the inner end of the stop plate 33 and at the other end to the first shaft, permitting the stop plate 33 to move toward or away from the left connecting component 31 along the length of the right connecting component 32. The stop plate 33 has a downward extended vertical projection 331 provided near its outer end at an adequate position. A push plate 34 is provided at a bottom side of the stop plate 33. As shown in FIG. 6, the push plate 34 has a push portion projecting from a lateral side of the stop plate and through the first slot 321 on the side wall of the right connecting component 32, an inward reduced middle shoulder portion, and a reduced neck portion opposite to the push portion. A second spring 36 is put over the reduced neck portion of the push plate 34. When the push plate 34 is pushed toward the side wall of the right connecting component 32, the stop plate 33 is moved away from the left connecting component 31.

Figure 7:
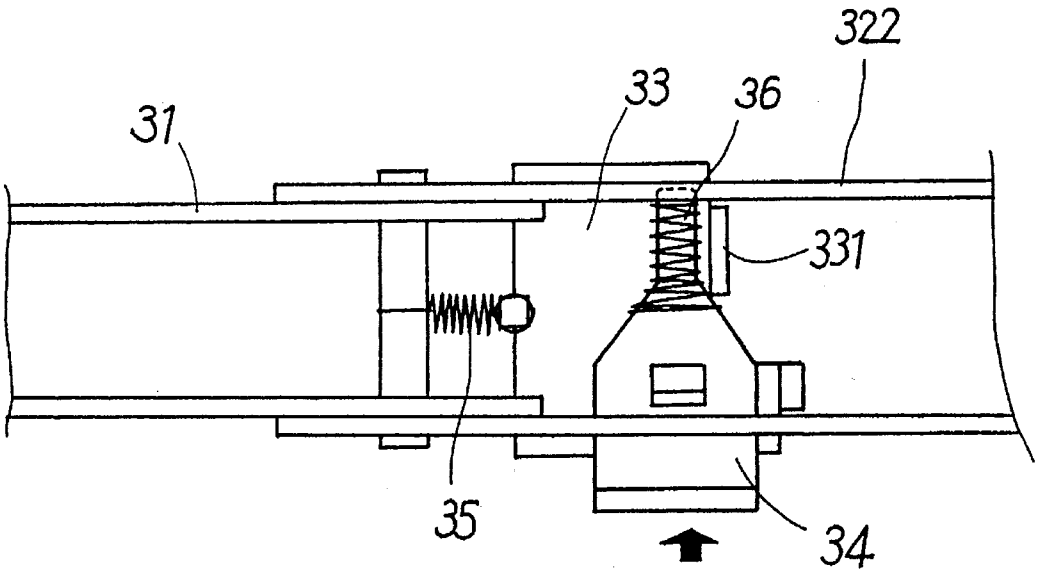
FIG. 7 illustrates the operation of the foldable joint connecting member of the present invention.
Figure 8:
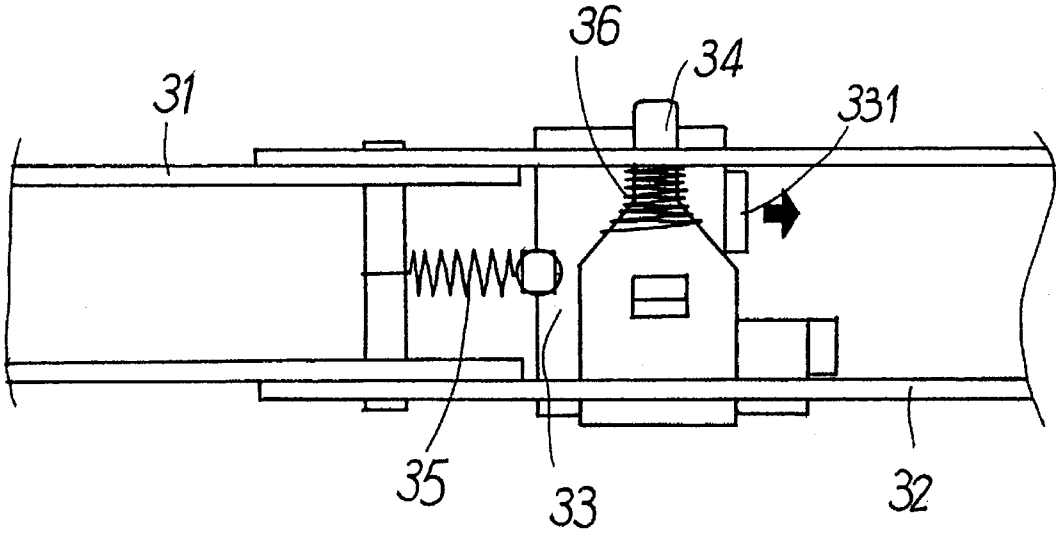
FIG. 8 is another view showing the operation of the foldable joint connecting member of the present invention.
Figure 9:
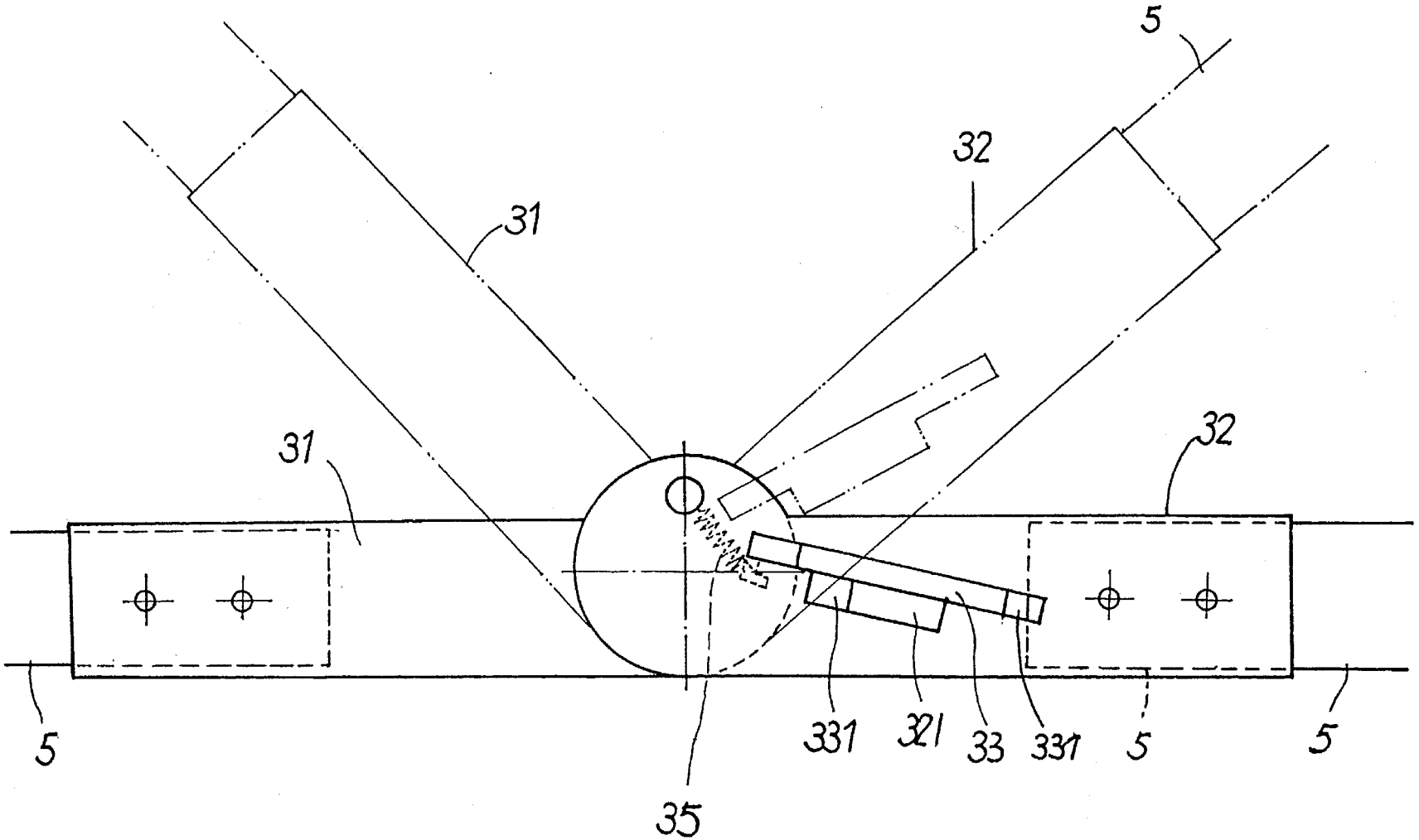
FIG. 9 is still another view showing the operation of the foldable joint connecting member of the present ivnention.
Figure 10:
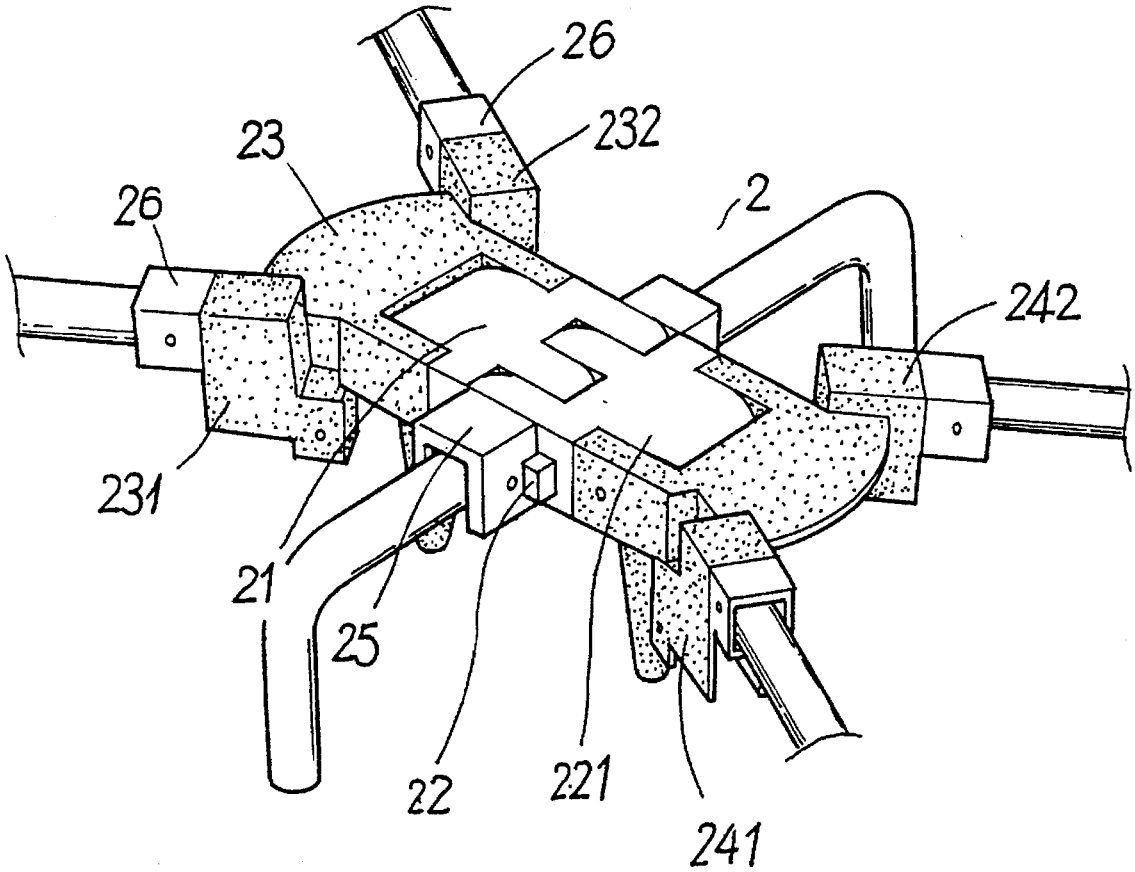
FIG. 10 is an assembled perspective of the foldable hub member of the present invention.
Figure 11:
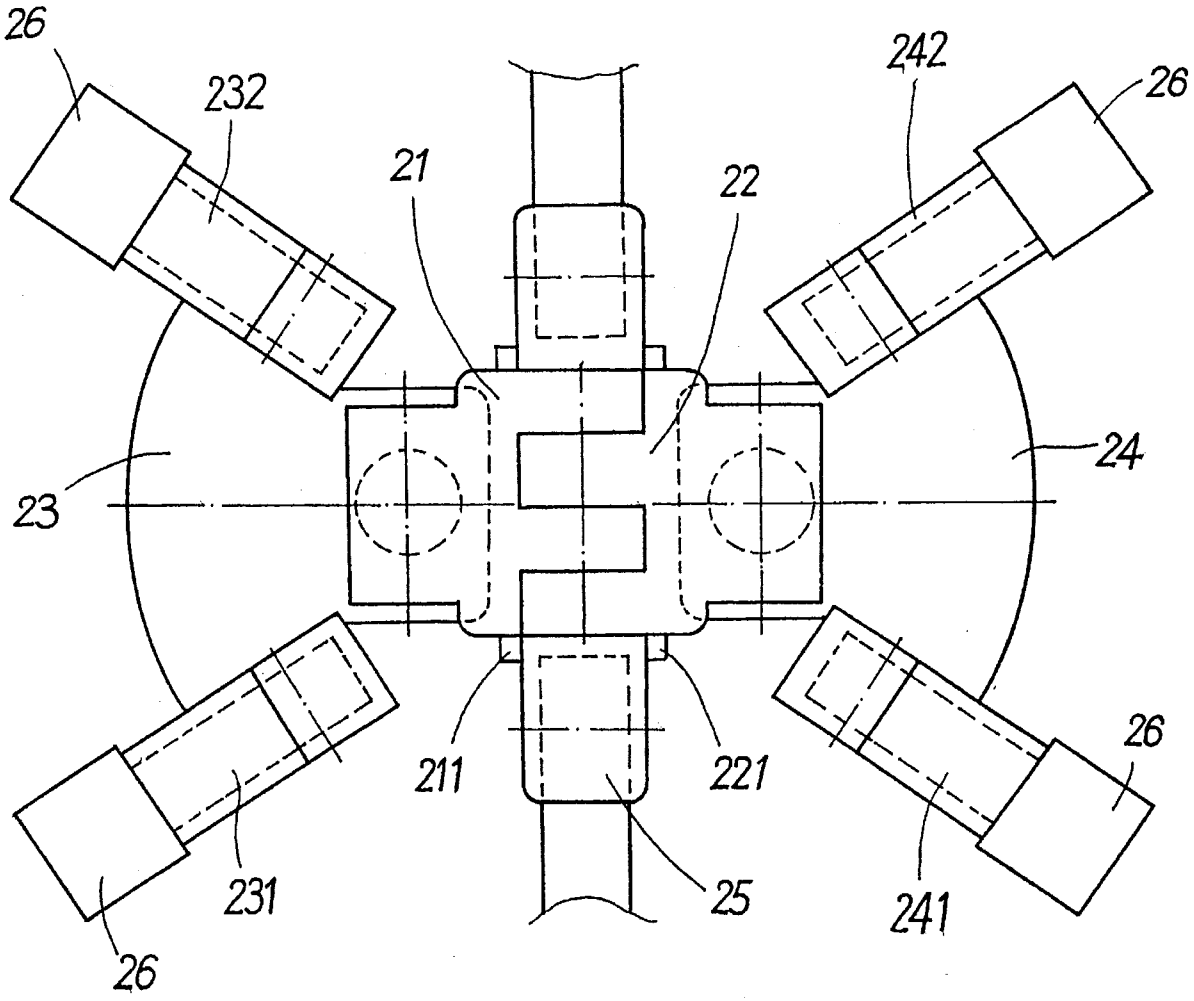
FIG. 11 is a top view of the foldable hub member of FIG. 10.
Figure 12:
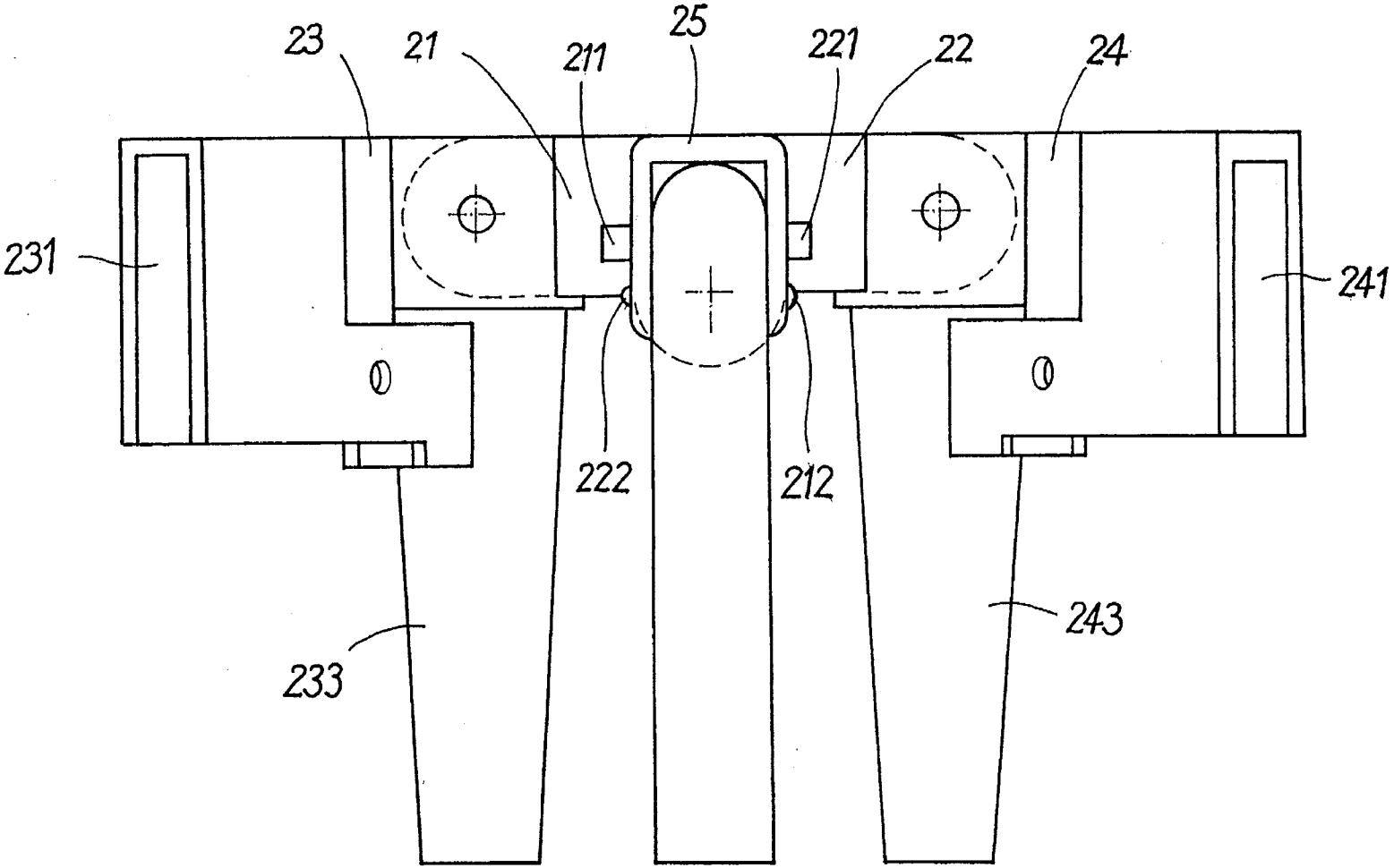
FIG. 12 is a front view of the foldable hub member of FIG. 10.

To operate the foldable joint connecting member 3, first laterally push the the push plate 34 toward the right connecting component 32 in a direction as shown by the arrow in FIG. 7, the reduced middle shoulder portion of the push plate 34 shall contact with the downward extended projection 331 of the stop plate 33 and force the latter and accordingly the stop plate 33 to move backward in a direction as shown by the arrow in FIG. 8 when the push plate 34 is kept pushed into the right connecting component 32. When the stop plate 33 is forced backward and finally disengages from the cuts at the arcuated inner end of the left connecting component 31, the joint of the left and the right connecting components 31, 32 can be bent, allowing the left connecting component 31 along with the horizontal rail 5 connected thereto to be pivotally turned clockwise about the first shaft to a folded position, as shwon in FIG. 9. At this point, the inner end of the stop plate 33 presses against an outer periphery of the arcuated end of the left connecting component 31 and thereby stops the latter from returning to its previously extended position. To extend the folded joint connecting member 3, push the left connecting component 31 counterclosewise to turn about the first shaft until the stop plate 33 engages with the cuts at the arcuated inner end of the left connecting component 31 again. At this point, the spring 35 shall pull the stop plate 33 to move toward the left connecting component 31 while the downward extended vertical projection 331 of the stop plate 33 contacts with the reduced shoulder portion of the push plate 34 and forces the latter to move in a reverse direction to the previous position.

Please now refer to FIGS. 10 through 15. The foldable hub member 2 is disposed at a central position near the bottom of the framework 1 to receive four lower horizontal rails 5 radially extending toward and connecting with the four lower corner leg connecting members 12. The foldable hub member 2 comprises two symmetrical and pivotally connected parts, namely, the first part and the second part. The first and the second parts of the foldable hub member 2 respectively consists of a first and a second supporting components 23 and 24, and a first and a second pivot components 21 and 22. The first and the second supporting components 23, 24 have a a lower leg 233, 243, respectively, at their bottom and two coupling components 231, 232 and 241, 242, respectively, at their two outer corners. The first and the second pivot components 21, 22 are pivotally connected at their outer ends to an inner end of the first and the second supporting components 23, 24, respectively, and at their inner ends to each other by means of a second shaft. The first and the second pivot components 21, 22 both have a side leg coupling component 25 provided at one lateral side so that two opposite side legs are separately and pivotally received in the side leg coupling components 25 to form a secondary supporting means of the framework 1 in addition to the four vertical corner rails 5. Moreover, the first and the second pivot components 21, 22 are respectively provided with a side locating block 211, 221 (see FIG. 11), a lower engaging boss 212, 222 (see FIG. 12), and a lower protuberance 213, 223 (see FIG. 13). As more clearly shown in FIG. 15, a hinge component 26 is pivotally connected at one end to each of the coupling components 231, 232, 241, 242 near a bottom portion thereof, and at the other end to one end of one of the radially extended lower horizontal rails 5, permitting the foldable hub member 2 and the whole framework 1 to be collapsed and folded to occupy a room as small as possible.

Figure 13:
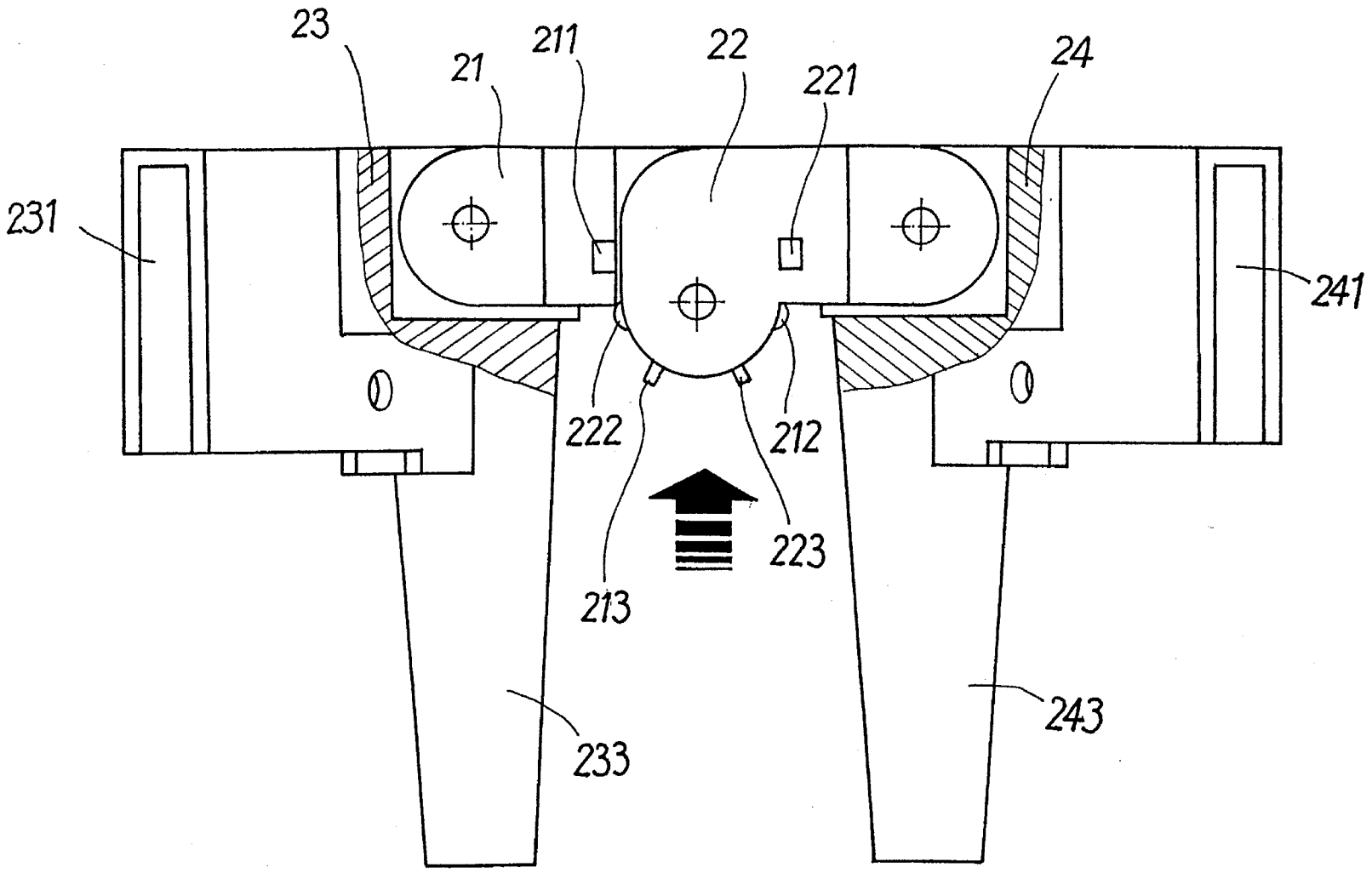
FIG. 13 illustrates the operation of the foldable hub member of the present invention.
Figure 14:
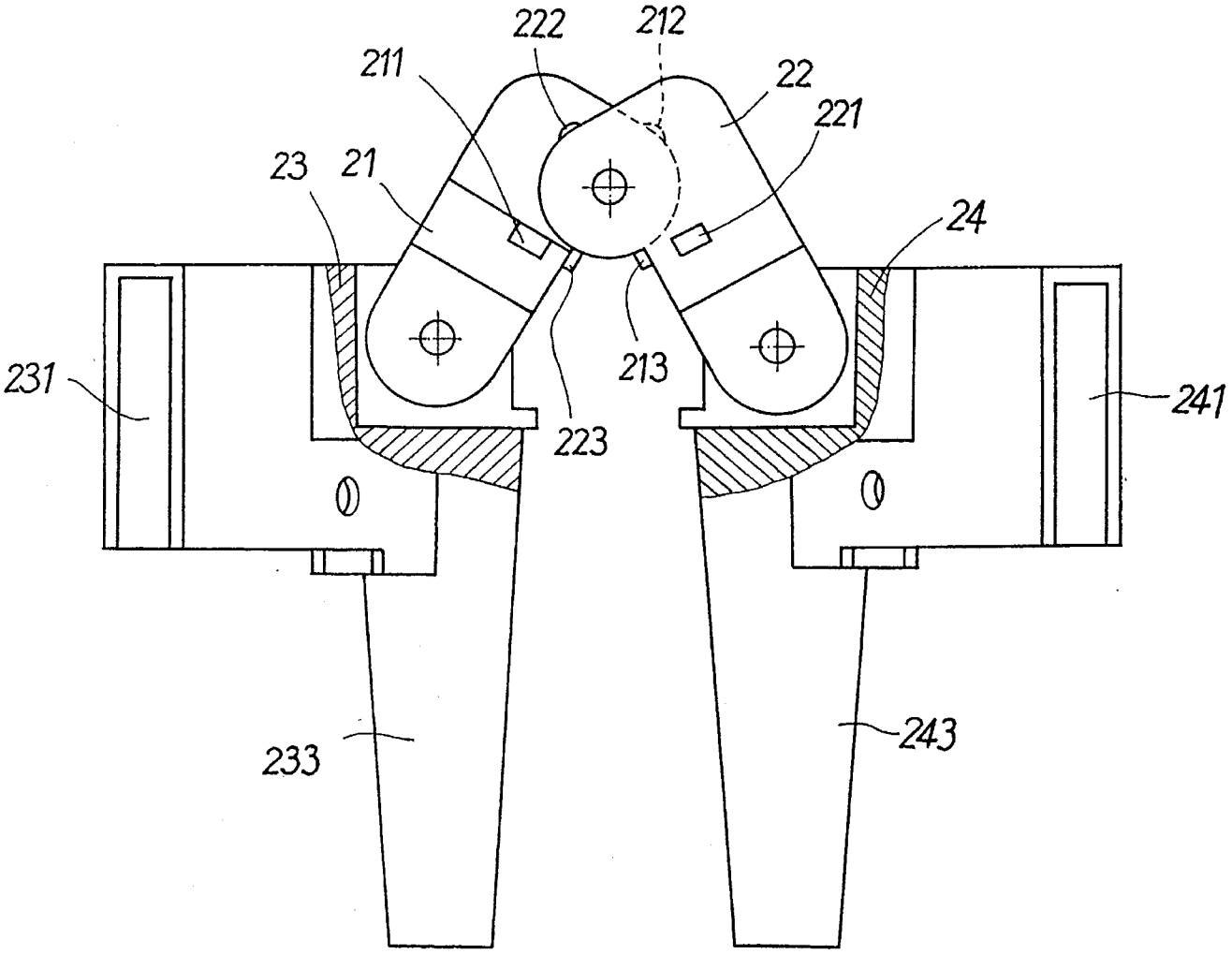
FIG. 14 is another view showing the operation of the foldable hub member of the present invention.
Figure 15:
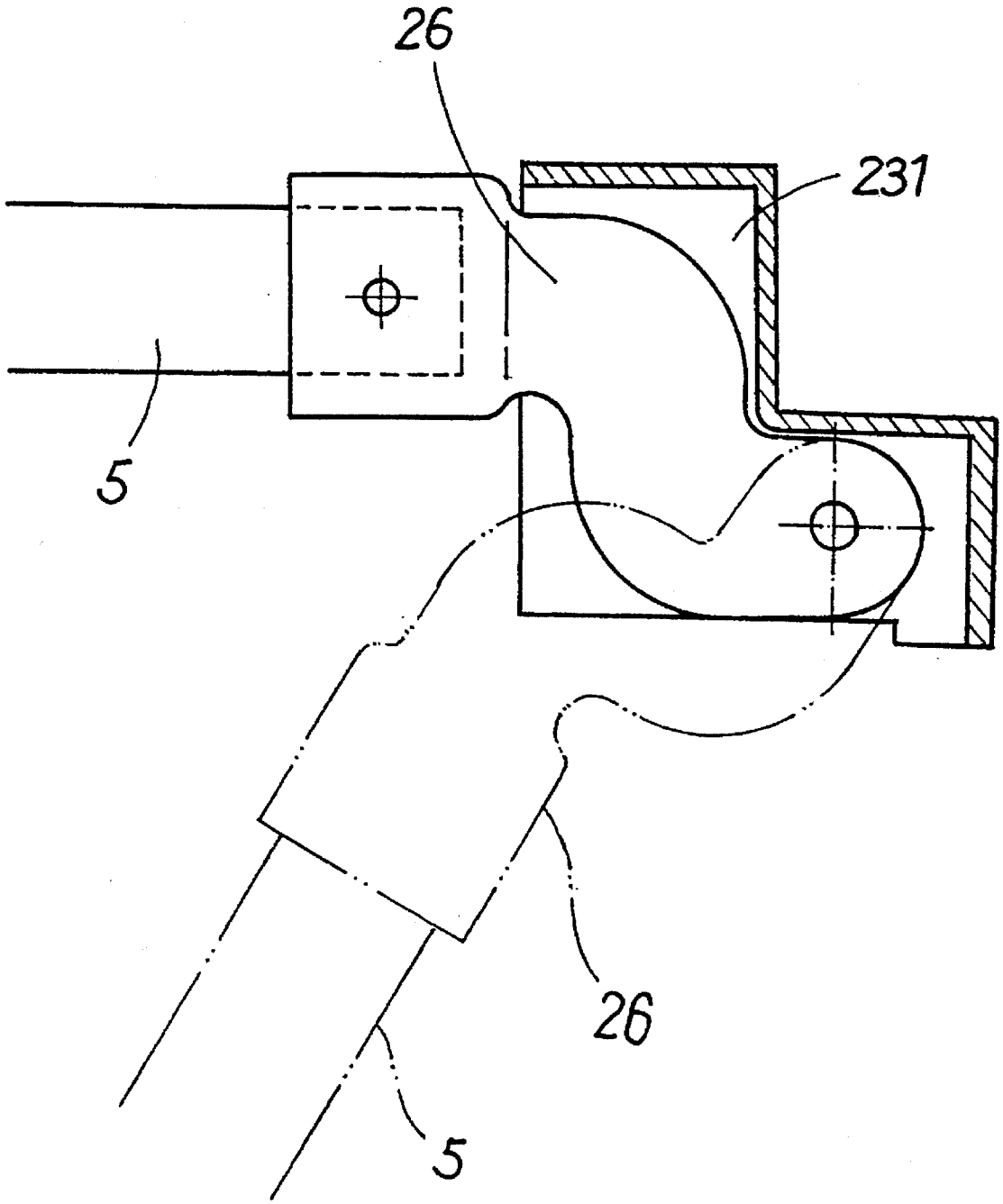
FIG. 15 illustrates the operation of the hinge component in the coupling component of the hub member of the present invention.

To operate the foldable hub member 2, apply force to the hub member 2 in a direction as shown by the arrow in FIG. 13, so that the first and the second pivot components 21, 22 are turned about the second shaft to arch upward, causing the two lower engaging bosses 212, 222 to move away from a surface parallel to a flat bottom surface of the first and the second pivot components 21, 22 until the two lower protuberlances 213, 223 are stuck in place by the flat bottom surface of the second and the first pivot component, respectively, as shown in FIG. 14.

When the two pivot components 21, 22 are upward arched, the hinge components 26 pivotally connected to the coupling components 231, 232, 241, 242 and the lower horizontal rails 5 pivotally connected to the hinge components 26 are turned counterclockwise at the same time, which further raises the arched hub member 2 and facilitate the folding together of the hub member 2.

To extend the folded hub member 2 again, operate the above steps reversely. First downward press against the first and the second pivot components 21, 22 until the two lower engaging bosses 212, 222 return to their original lower position in a plane parallel to the flat bottom surfaces of the two pivot components 21, 22, pull the hinge components 26 and the lower horizontal rails 5 to a horizontal position, and then extend the side leg coupling components 25 and the side legs to form the secondary supporting means, so that the framework 1 can stand stably with the four vertical corner rails 5 connected to and normal to the four lower horizontal rails radially extended form the hub member 2 forming the main supporting means.

Figure 2:
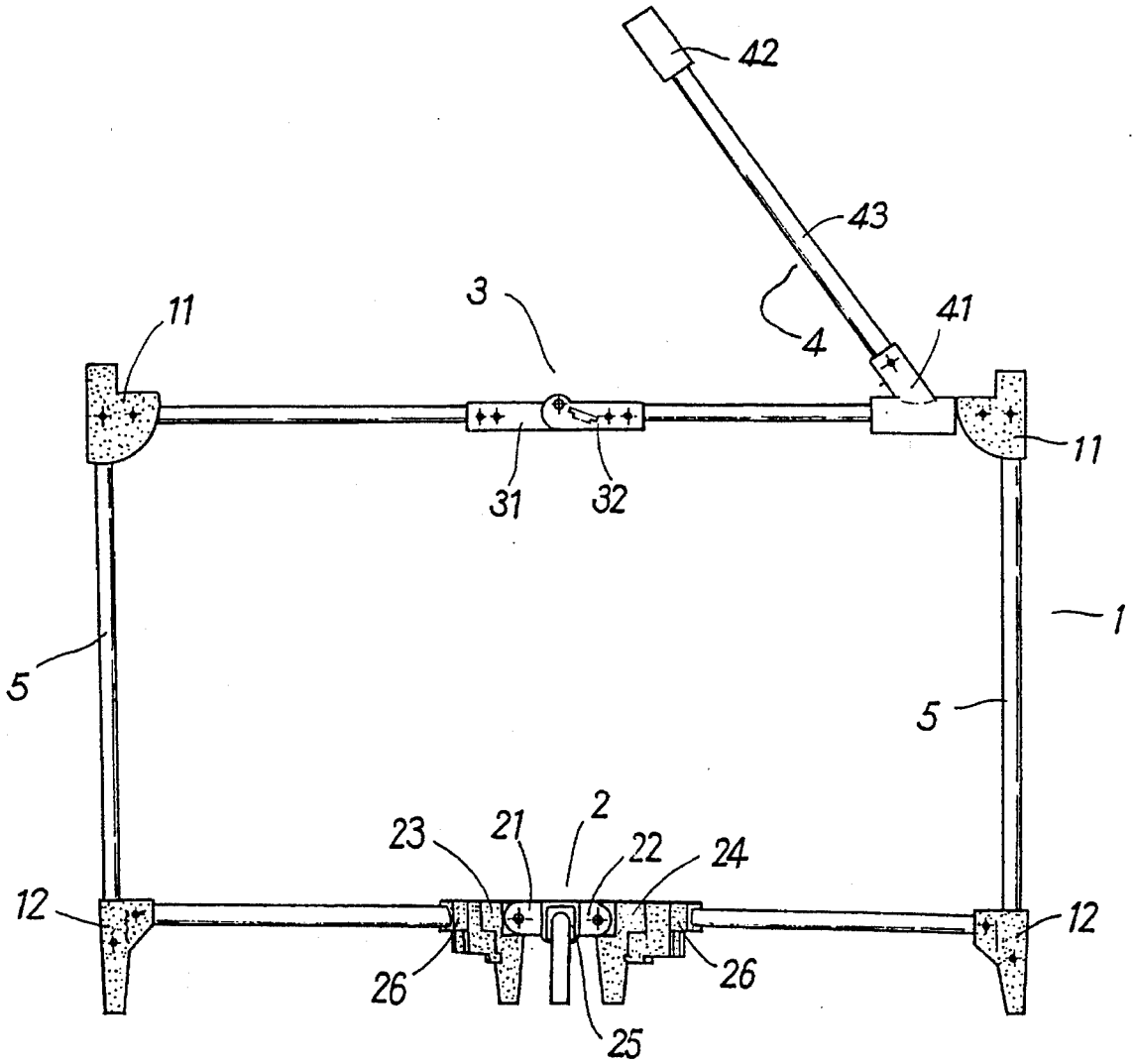
FIG. 2 is a front view of the playyard of FIG. 1.
Figure 3:
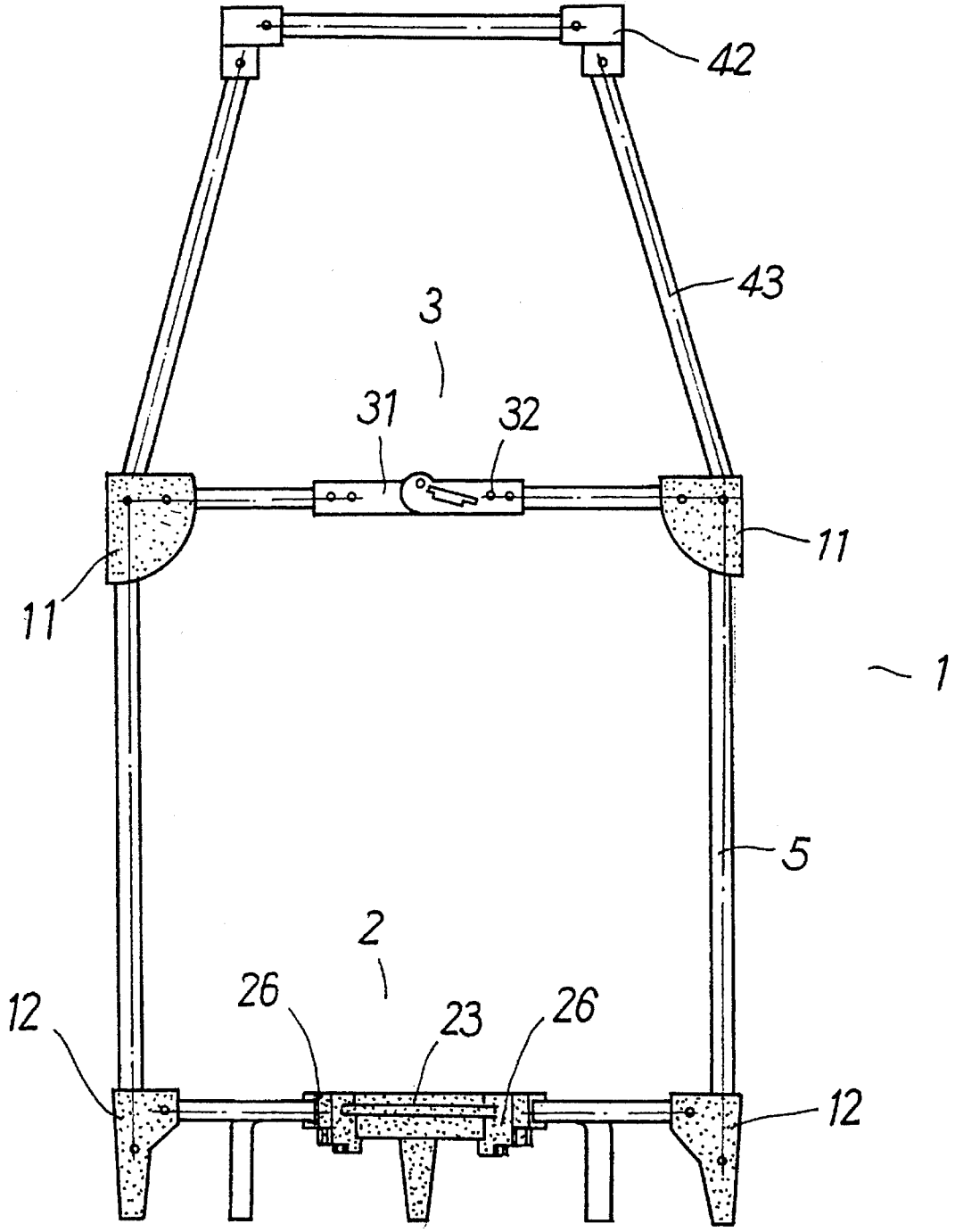
FIG. 3 is a left side view of the playyard of FIG. 1.
Figure 4:
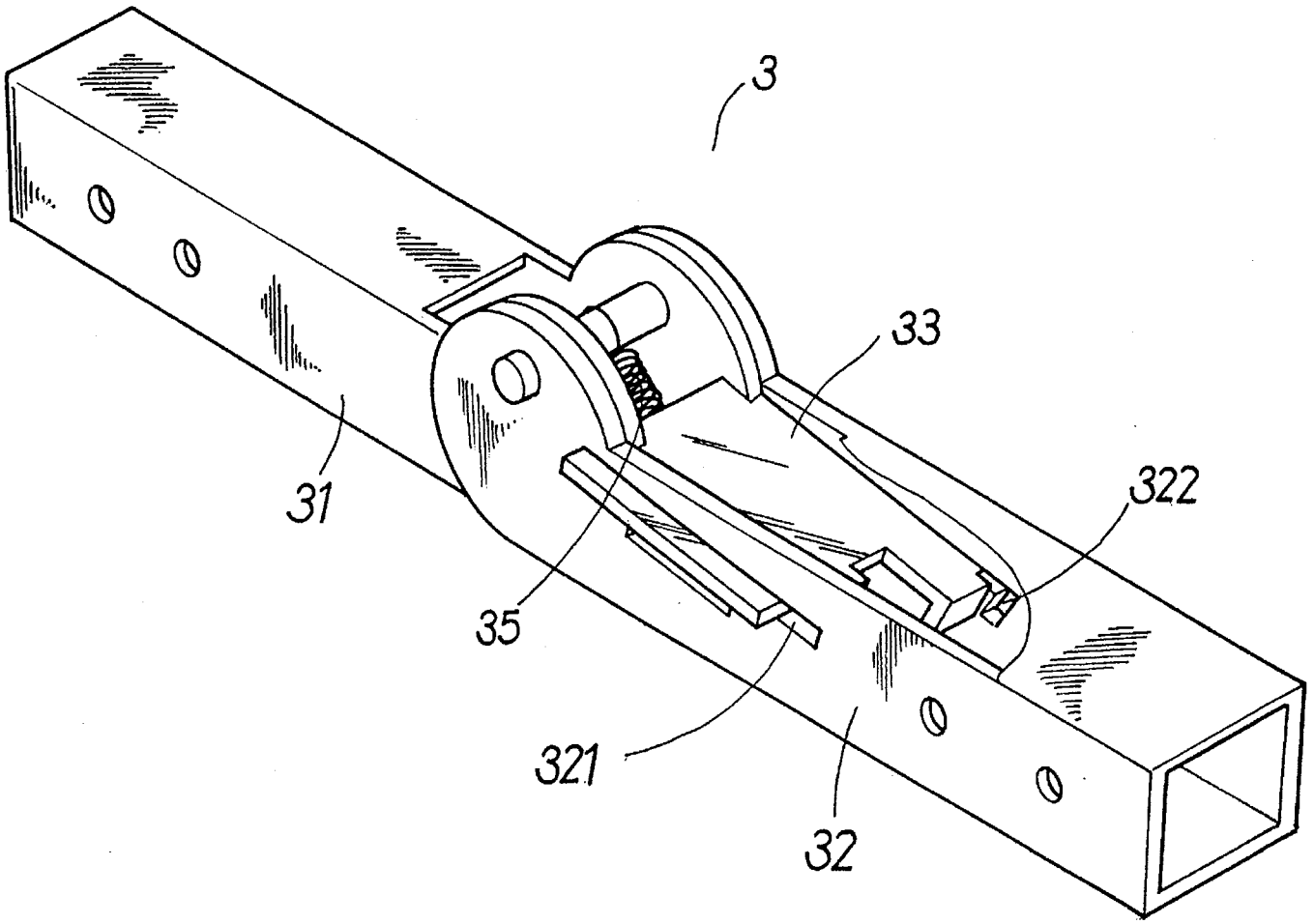
FIG. 4 is an assembled perspective of a foldable joint connecting member according to the present invention.
Figure 5:
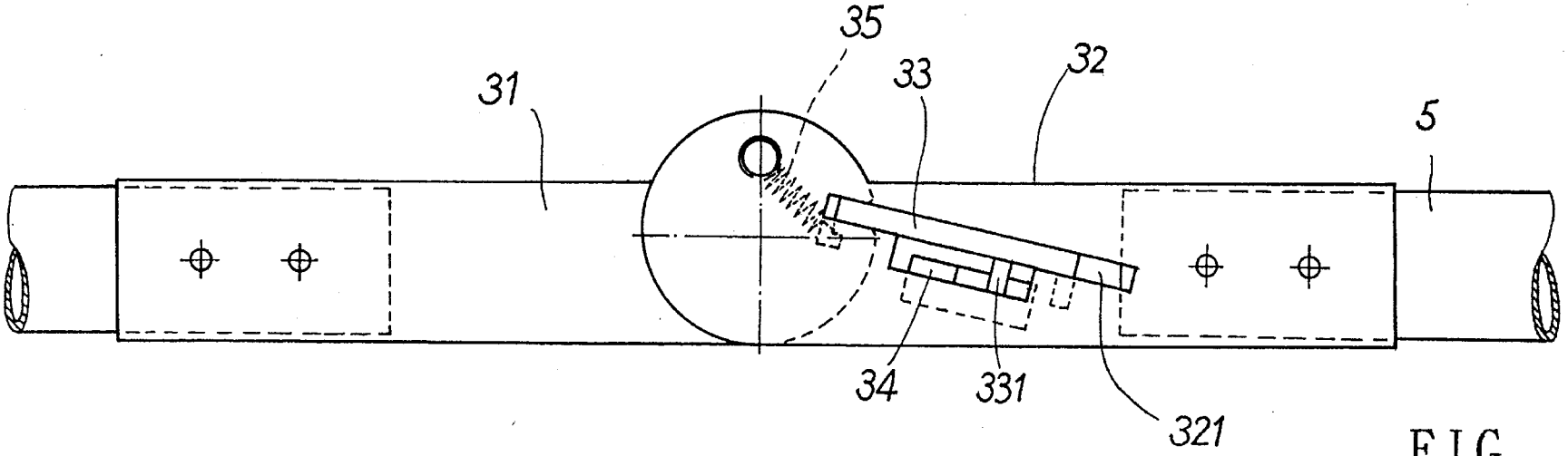
FIG. 5 is a front view of the foldable joint connecting member of FIG. 4.
Figure 16:
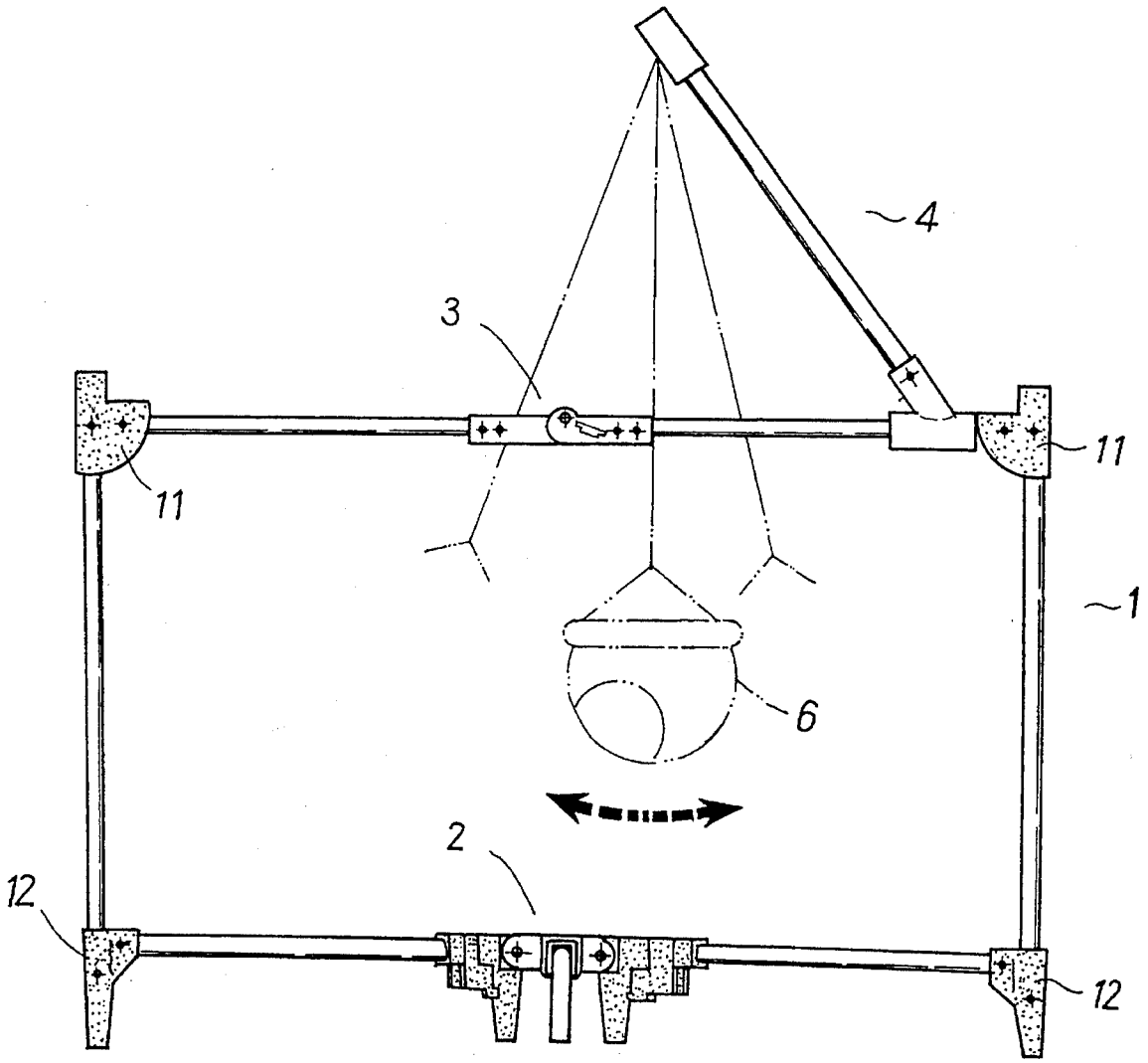
FIG. 16 illustrates the present invention with a craddle hung on the optional supporting rack.

Please refer to FIGS. 2, 3, and 16, the supporting rack 4 can be optionally attached to the framework 1 by providing on two parallel upper horizontal rails 5 near the upper corner rail connecting members 11 each with a Y-shaped union 41, such that two arms 43 may be fixedly connected at their lower ends to the unions 41 and at their upper ends to a hanger 42 above the playyard. The craddle 6 or the like can be hung on the hanger 42 for a baby to sit or lie thereon.

Figure 17:
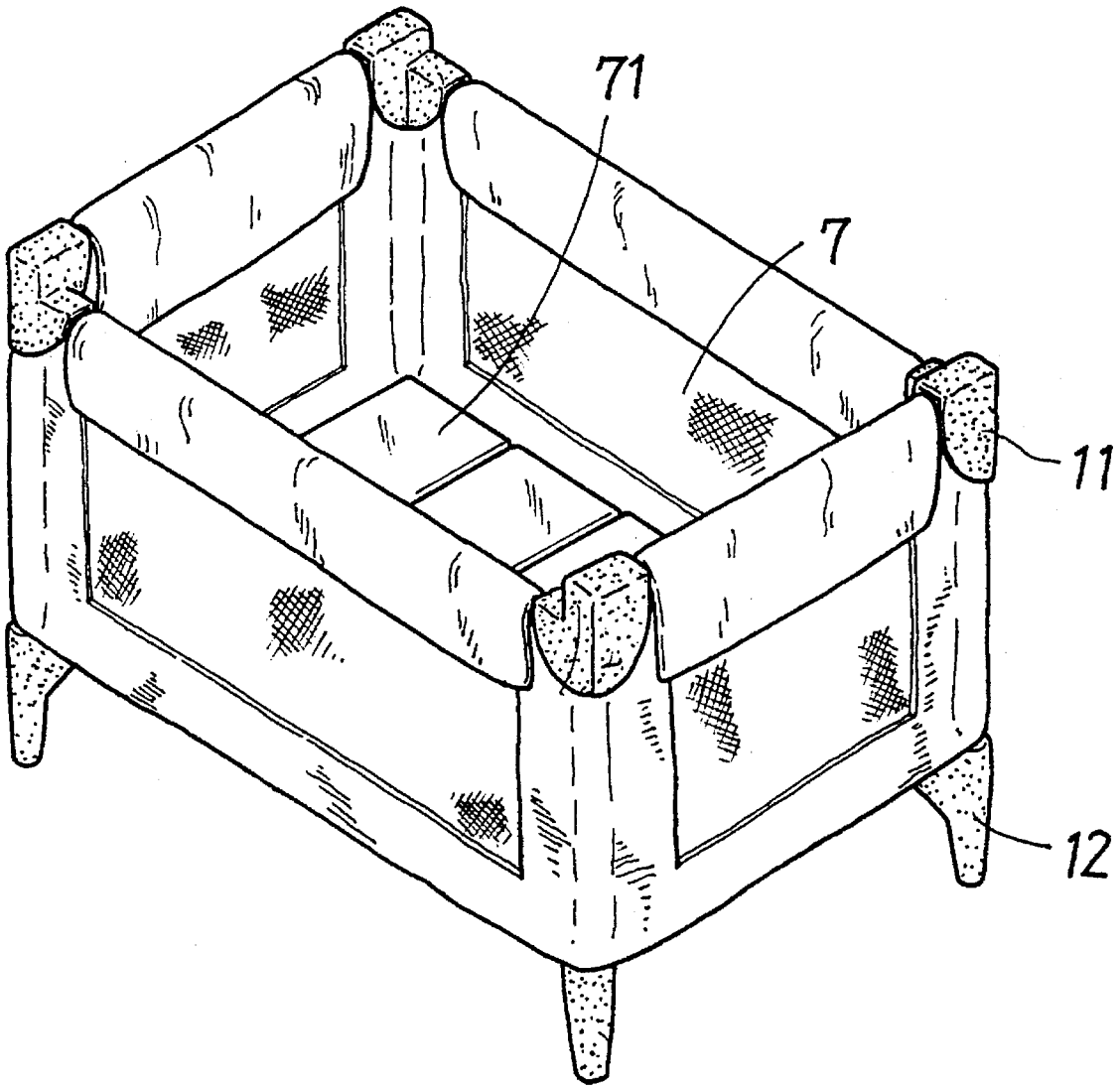
FIG. 17 illustrates an erected foldable playyard of the present invention with fabric enclosure and floor cushions.
Figure 18:
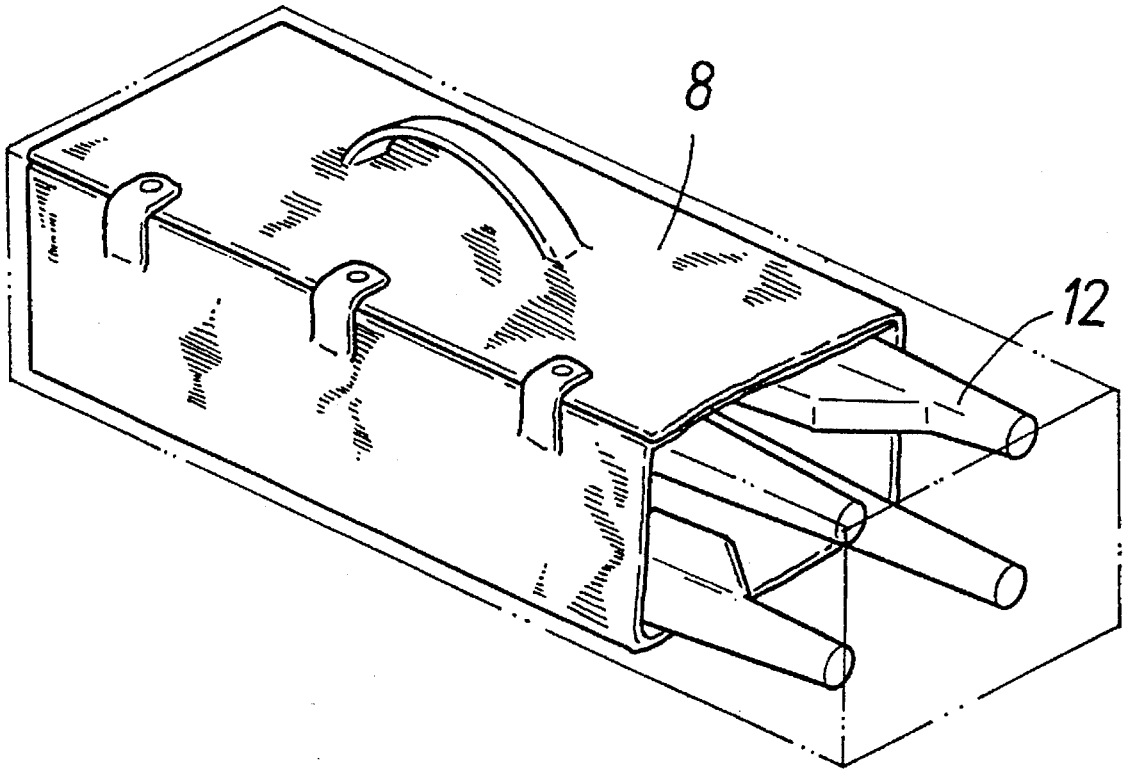
FIG. 18 illustrates the present invention in a collapsed and folded state and being wrapped with a carrying case.

FIG. 17 illustrates an embodiment of the present invention in which the framework 1 has been wrapped with a fabric enclosure and provided with floor cushions 71 to form a safe and comfortable bed 7 FIG. 18 illustrates the present invention in a collapsed and folded state and being wrapped with a carrying case 8 for easy and convenient carry.

With the above arrangements, the present invention of the foldable baby playyard has improved foldable bottom hub member and foldable joint connecting members which facilitate convenient, quick, and most important, safe collapsing and extending of the framework of the playyard. The playyard of the present invention can be safely used by a baby without the risk of becoming unexpectedly collapsed or unstably swayed due to any force applied to the foldable hub member and/or the foldable joint connecting members by the baby in the playyard.

What is claimed is:

1. A foldable baby playyard comprising a framework and floor members, said framework comprising four vertical corner rails pivotally connected at their upper ends to upper corner rail connecting members and fixedly connected at their lower ends to corner leg connecting members, four lower horizontal rails separately and pivotally connected at one end to said lower corner leg connecting members and at the other end to a foldable hub member disposed at a bottom central point of said framework, and four pairs of upper horizontal rails separately extending between and connected at two outer ends to a pair of adjacent upper corner rail connecting members, with said upper horizontal rails forming each said horizontal rail pair being pivotally connected at their inner ends by means of a foldable joint connecting members;

said foldable hub member comprising two symmetrical parts, said two parts respectively consisting of a first and a second supporting components, and a first and a second pivot components; said first and said second supporting components each having a lower leg at their bottom and two coupling components at their two outer corners to each pivotally connect at a lower end with a hinge component such that said hinge component connects at the other end thereof to one end of one of said lower horizontal rails; said first and said second pivot components being pivotally connected at their outer ends to an inner end of said first and said second supporting components and at their inner ends to each other by means Of a pivot shaft; said first and said second pivot components both having a side leg coupling component provided at one lateral side so that two opposite side legs are separately and pivotally received in said side leg coupling components to form a secondary supporting means of said framework in addition to said four vertical corner rails; and said foldable joint connecting members each comprising two tubular connecting components pivotally connected at their arcuated inner ends by means of a pivot pin, one of said tubular connecting components being provided on each side wall with a slot so that a stop plate is disposed within said sloted tubular connecting component with its two lateral sides extending and projecting through said two slots; said stop plate having an inner end which is engaged into and stopped by two cuts formed at said arcuated inner end of another tubular connecting component; a spring being connected between said stop plate and said pivot pin so that said stop plate is allowed to move along said slots; a push plate having a reduced middle shoulder portion being disposed below said stop plate such that said push plate contacts with and forces a downward extended vertical projection of said stop plate, and accordingly said stop plate itself, to move in a direction opposite to said pivot pin and disengage from said cuts on said arcuated inner end of said another tubular connecting component when said push plate is laterally pushed toward said stop plate.

2. A foldable baby playyard as claimed in claim 1, wherein said first and said second pivot components of said foldable hub member are respectively provided with a side locating block, a lower engaging boss, and a lower protuberance; wherein said foldable hub member can be folded by applying a force to said hub member from a bottom side thereof so that said first and said second pivot components are turned about said pivot shaft to arch upward, causing said lower engaging bosses to move away from a surface parallel to a flat bottom surface of said first and said second pivot components until said lower protuberlances are stuck in place by said flat bottom surface of said second and said first pivot component, respectively, and wherein said hub member in a folded state can be extended by downward pressing against said first and said second pivot components until said lower engaging bosses return to their original lower position in a plane parallel to said flat bottom surfaces of said two pivot components.

* * * * *